United States Patent [19]

van Laar et al.

[11] Patent Number: 4,852,859

[45] Date of Patent: Aug. 1, 1989

[54] GASTIGHT BOTTOM CONSTRUCTION FOR A SHAFT FURNACE

[75] Inventors: Jacobus van Laar, Driehuis; Frank T. Niemeijer, Nieuwe Niedorp; Ronald J. Stokman, Hillegom, all of Netherlands

[73] Assignee: Hoogovens Groep B.V., IJmuiden, Netherlands

[21] Appl. No.: 162,502

[22] Filed: Mar. 1, 1988

[30] Foreign Application Priority Data

Mar. 5, 1987 [NL] Netherlands ..... 8700526

[51] Int. Cl.[4] ..... C21B 7/06

[52] U.S. Cl. ..... 266/197; 266/285; 432/95

[58] Field of Search ..... 266/193, 197, 280, 282, 266/285, 286; 432/95, 251

[56] References Cited

U.S. PATENT DOCUMENTS 3,846,068 11/1974 Van Laar ..... 266/197
4,157,815 6/1979 Saviski et al. ..... 266/280

FOREIGN PATENT DOCUMENTS 1174934 7/1964 Fed. Rep. of Germany .
2105102 8/1972 Fed. Rep. of Germany .
1237188 6/1971 United Kingdom .
1312310 4/1973 United Kingdom .

*Primary Examiner*—S. Kastler
*Attorney, Agent, or Firm*—Stevens, Davis, Miller & Mosher

[57] ABSTRACT

A bottom construction for a shaft furnace, has a plurality of horizontal layers of refractory material, and a gastight metal membrane located above at least the lowest layer of refractory material. So that the membrane is easily constructed, can accommodate thermal movements and has a level upper surface, the layer of refractory material immediately underneath the metal membrane is formed of blocks and has a level top surface and the metal membrane is formed of loosely laid, mutually abutting metal plates which are stacked in at least three layers. The pattern of the joints of the plates of each of these three layers is offset, as seen in plan view, with respect to the pattern of the joints of both the other two layers. The plates may be copper sheets. The membrane may have a peripheral flange cemented in a slot at the furnace wall.

6 Claims, 2 Drawing Sheets

GASTIGHT BOTTOM CONSTRUCTION FOR A SHAFT FURNACE

BACKGROUND OF THE INVENTION

1. Field of the Invention

The invention relates to a gastight bottom construction for a shaft furnace, having a plurality of horizontal layers of refractory material and a gastight metal membrane above at least the lowermost of the refractory material layers. The membrane is sealed to the furnace shell.

2. Description of the Prior Art

A bottom construction is disclosed in U.S. Pat. No. 4,157,815 in which a metal membrane or separating layer is described in combination with a cooling system in the bottom formed by tubes through which coolant flows. These tubes and the metal membrane are located in a rammed layer of refractory material. The metal membrane serves to prevent gas leakage into the cooling system and liquid leakage. from the cooling system to the inside of the furnace. The metal membrane consists of a single layer of copper plate or a plate of some other metal which is formed by brazing together strips and brazing edging pieces to the steel shell of the furnace to give a single coherent layer.

As a rule metallurgical shaft furnaces, and blast furnaces in particular, are constructed without means of cooling in the bottom, the bottom construction of refractory material being directly built up on a supporting structure of non-refractory bricks or concrete within an approximately cylindrical wall construction. If the furnace is operated under raised gas pressure, this type of bottom construction can permit gas to leak away downwards and escape under the bottom edge of the steel shell. This can be dangerous, and from the operating point of view is undesirable. The need has therefore arisen for a gastight bottom construction for a furnace which is not provided with cooling means in the bottom and which therefore may not have a rammed layer of refractory material.

In addition, there are disadvantages of a gastight metal membrane consisting of one piece, which may for example be made by brazing strips together. In the first place the fabrication of such a membrane and its attachment to the steel shell is very labour-intensive and requires precise control. Furthermore, during the heating of the furnace from cold the thermal expansion of the shell and of the refractory construction of the bottom, as a whole and in its component parts, can give rise to high stresses in the metal membrane, with very high local stress concentrations. The consequence of this can be failure of the gastightness of the membrane. In the case of a bottom construction which includes layers of refractory blocks it is very undesirable to have a metal membrane of plates or strips brazed together. For example, the local thicker parts which result from the brazed seams impede the stacking of a compact flat layer of refractory blocks above the membrane. Because the blocks do not lie properly on the membrane, a very irregular thermal contact pattern is produced, which can cause undesirable temperature differences throughout the bottom construction.

SUMMARY OF THE INVENTION

The object of the invention is to overcome the abovementioned disadvantages and to make possible the use of a gastight metal membrane in a furnace having a bottom construction built up of refractory blocks without a rammed layer and without a cooling system. The invention however does not prevent the incorporation of a rammed layer or of a cooling system. Thus the invention is equally applicable to a bottom construction with rammed layer and cooling system.

The invention consists in that the layer of refractory material immediately under the metal membrane is formed of blocks and has a level top surface, and in that the metal membrane is formed of unbonded, mutually abutting plates which are stacked in at least three layers, the pattern of the joints of the plates of each of these three layers being offset, as seen in plan view, with respect to the pattern of the joints of both of the other two layers.

The plates of the membrane are therefore not welded or brazed together, but lie unbonded next to and on top of each other. As a consequence of this, the structure is insensitive to thermal movements and can follow them completely. In the absence of brazed or welded seams a completely flat membrane can be obtained, on which a further layer or layers of the bottom formed of blocks can be precisely stacked. Also, because the membrane has three layers with mutually offset joint patterns between the abutting component plates, there are no passages through the joints. The only remaining leakage points for gas transport are formed by surface inaccuracies in the plates, but these ca be reduced to a completely acceptable level.

The gastight attachment of the membrane to the steel shell of the furnace is preferably achieved in the invention in that the metal membrane has an upwardly directed flange directed around its periphery against the steel furnace shell. This flange extends into a slot closed at its top which is provided at the shell, and the flange and the slot are sealed to each other in a gastight manner by cement. Because the membrane is built up of loose plates which can have much smaller dimensions than the furnace diameter, the flanged edge of the membrane can be made by flanging the individual plates in straight lines. Deviations of the flanged edge from true circular shape can then be simply accommodated by the width of the slot and the flexibility of the thin plate material. Because the seal between the flanged edge and the slot is situated at a point in the furnace construction which is cool, a permanent gastight seal using for example silicon cement as the packing material will be suitable.

The membrane can be made of metal plates consisting of various materials. Preferred are materials which have a reliable corrosion-resistance. Plates of stainless steel can be used, but preferred are copper plates with a thickness in the range 0.3 to 0.5 mm. These are moreover relatively cheap and easy to work. Even though the membrane is three layers high, these copper plates still provide a smaller thickness than that of the membrane described in U.S. Pat. No. 4,157,815.

Within the concept of the invention, many embodiments are possible having different joint patterns and plate dimensions of the plates of the membrane. Good results are obtained if, in at least one layer, the metal plates adjacent the furnace shell are radially arranged segments an the remainder are arranged according to a rectangular pattern, preferably with rectangular dimensions of approximately $1 \times 2$ meters.

The refractory layer underneath the membrane must have a level top surface. This is in order to give a good, flat support to the metal plates. The best results are here obtained if the metal membrane is located between two layers of refractory material which are both made of levelled graphite blocks. Graphite blocks can be very easily worked to precise dimensions, and by doing so a very good thermal contact with the copper separating layer is achieved.

Because a gastight barrier is formed in the furnace bottom by the metal membrane, when a new furnace bottom is put into service a problem can arise due to the occurrence of condensed water. Water from the refractory blocks evaporates from the centre of the furnace outwards and is driven downwards through the bottom so that, depending on the temperature distribution, condensation is possible. The condensed water cannot disappear through the bottom, and must consequently be removed in some other way. A solution for this problem is provided if, in the invention, near and above the periphery of the metal membrane at least one extraction pipe extends through the furnace shell, e.g. above the slot in which the membrane ends.

BRIEF INTRODUCTION OF THE DRAWINGS

A preferred embodiment of the invention is described below by way of non-limitative example with reference to the accompanying drawings, in which:

FIG. 1 shows diagrammatically a furnace bottom embodying the invention in longitudinal cross section, FIG. 2 shows in plan view and in four quadrants the various component layers of the membrane of the bottom of FIG. 1, and FIG. 3 shows a detail on an enlarged scale.

DESCRIPTION OF THE PREFERRED EMBODIMENT

Figure 1:
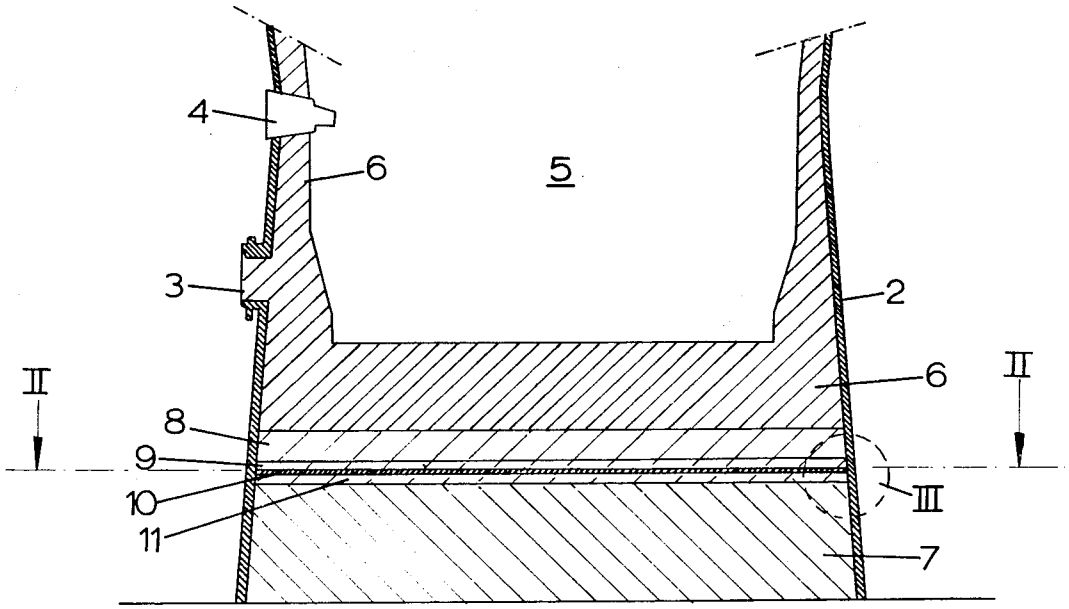

FIG. 1 shows the level 1 of the ground on which a steel shell 2 of a blast furnace is erected. The blast furnace is of conventional type with a location 3 for boring a tap hole and with tuyeres 4 which extend to the inside 5 of the furnace. The wall and bottom of the furnace are built up with a refractory lining 6 which rests on a foundation 7 made of non-refractory material. Between the brickwork 6 of the bottom and the foundation 7 there are, from top to bottom, a graphite lining 8, the lowest layer 9 of which is shown, a metal membrane of separating layer 10, and then a further graphite layer 11. The lower graphite layer 11 is formed of levelled blocks, and is then also levelled at its top surface. The layer 9 also consists of levelled graphite blocks.

Figure 2:
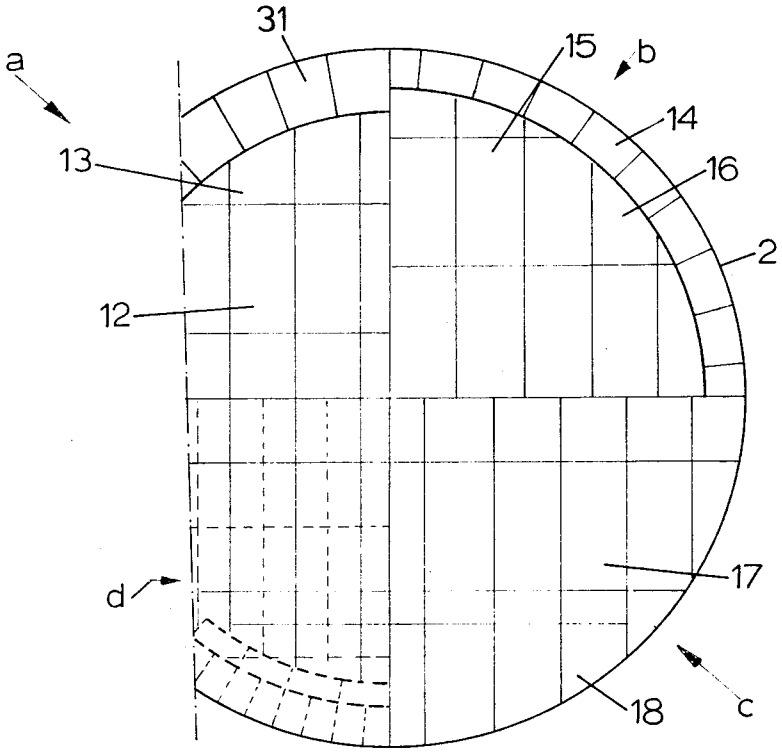

The metal membrane 10 is shown in greater detail in FIG. 2. FIG. 2 is a plan view on the line II—II in FIG. 1. The metal membrane 10 consists of three layers of unbonded, closely abutting copper plates with a thickness of 0.4 mm each. In FIG. 2, the three quadrants a,b and c show plan views of respectively the lowest, the middle and the uppermost of these three layers of copper plates. Quadrant d also gives a plan view of the uppermost layer, but in this case the position of the two underlying layers is also indicated by broken lines. It can be seen that the pattern of the joints in each layer does not correspond to the pattern of joints between the plates in either of the other two layers. Thus all joints are offset from the joints in the other two layers. In this way a substantially gastight membrane is obtained.

In quadrant a, reference number 31 indicates a row of segment-shaped plates which lie adjacent the furnace wall 2. Within them lie rectangular plates 12 with standard dimensions of 1×2 meters, and filler plates 13 which are cut from plates of the same standard dimensions.

In quadrant b, plates 14,15 and 16 are indicated in a similar manner and in quadrant c plates 17 and 18. In quadrant c only rectangular and filler plates are fitted, in other words there are no segment-shaped plates along the furnace wall 2.

Figure 3:
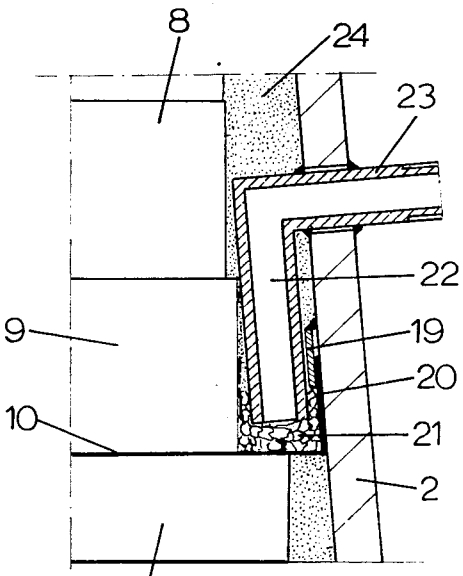

FIG. 3 shows a detail II from FIG. 1 on an enlarged scale. It is shown that a steel strip 19 is located at a small spacing from the furnace wall 2, being welded tightly at its upper edge to the wall 2. This strip 19 extends peripherally all around the wall 2. In this way a slot opening downwards is formed, into which flanged edges 20 of the plates of the metal membrane 10 project. The metal membrane 10 and the steel strip 19 are sealed together in a gastight manner by silicon cement. In the angle which is formed by the horizontal part of the membrane 10 and the flanged edge 20 a small layer 21 of gravel is inserted outside the layer 9. An extraction pipe 22 extends into this layer of gravel 21, passing with an angle part 23, gastightly through the furnace shell 2. A closure is fitted at the part 23 outside the furnace to which a pumping system can be connected, for the extraction of condensed water collecting on the membrane.

What is claimed is:

1. Gastight bottom construction for a shaft furnace, having a peripheral shell, which bottom construction comprises (a) a plurality of horizontal layers of refractory material arranged one above another, and (b) a horizontal gastight metal membrane sealed to the shell and located on one of said layers of refractory material, said refractory material layer on which said metal membrane being located is formed of refractory blocks and having a level upper surface, and (c) said metal membrane being formed of unbonded, mutually abutting metal plates which are stacked in at least three layers, each of said three layers having, as seen in plan view, a pattern of joints between its said plates which is offset with respect to the pattern of the joints of both of the other two said layers.

2. The bottom construction according to claim 1 wherein said metal plates of the membrane are copper plates having a thickness in the range 0.3 to 0.5 mm.

3. Bottom construction according to claim 1 wherein the metal membrane has an upwardly directed flange around its periphery located against the furnace shell, there being a slot formed at the shell and closed at its top, the flange of the membrane extending into the slot and being rendered gastight to the shell by cement.

4. Bottom construction according to claim 3 wherein at least one extraction pipe for water is provided which opens near and above the periphery of the metal membrane, which pipe extends through the furnace shell above said slot.

5. Bottom construction according to claim 1 wherein in at least one said layer of the membrane, said metal plates adjacent the furnace shell are radially arranged segments and the remaining metal plates are arranged in a rectangular pattern.

6. Bottom construction according to claim 1 wherein the metal membrane is held between said layers of refractory material having a level top surface and a second layer, both layers being formed of levelled graphite blocks.

* * * * *